US005139136A

United States Patent [19]

Eickhoff et al.

[11] Patent Number: 5,139,136

[45] Date of Patent: Aug. 18, 1992

[54] STAMP POUCH

[76] Inventors: Phillip C. Eickhoff; Roselyn M. Eickhoff, both of P.O. Box 1091, Fond du Lac, Wis. 54935

[21] Appl. No.: 549,923

[22] Filed: Aug. 13, 1990

[51] Int. Cl.[5] ..... A45C 15/00

[52] U.S. Cl. ..... 206/38; 206/37; 206/449; 206/460; 283/71; 40/156

[58] Field of Search ..... 206/37, 38, 215, 447, 206/449, 451, 460, 484, 610, 612; 229/87.01, 87.05; 283/71; 40/156, 159

[56] References Cited

U.S. PATENT DOCUMENTS

| | | | |
|---|---|---|---|
| 1,977,667 | 10/1934 | Breitkreuz | 206/443 |
| 2,176,292 | 10/1939 | Brown et al. | 40/159 |
| 2,179,884 | 11/1939 | Falkoff | 40/159 |
| 2,193,296 | 3/1940 | Pienzak | 40/159 |
| 2,508,854 | 5/1950 | Brodsky | 40/159 |
| 2,604,710 | 7/1952 | Beaune | 283/71 |
| 2,979,840 | 4/1961 | Eastman | 206/447 |
| 3,245,166 | 4/1966 | Hagner | 210/159 |
| 3,347,361 | 10/1967 | Lindeke | 206/447 |
| 3,361,252 | 1/1968 | Wise | 206/447 |
| 3,655,494 | 4/1972 | Buzzell | 40/159 |
| 3,792,542 | 2/1974 | Cohan | 206/37 |
| 4,185,405 | 1/1980 | Giulie | 40/159 |
| 4,711,347 | 12/1987 | Drexler et al. | 206/38 |
| 4,807,807 | 2/1989 | Glick | 229/92.8 |
| 4,844,246 | 7/1989 | Harrison et al. | 206/460 |
| 4,872,706 | 10/1989 | Brewen et al. | 383/71 |
| 4,896,027 | 1/1990 | Drexler | 40/159 |

FOREIGN PATENT DOCUMENTS

| | | | |
|---|---|---|---|
| 264775 | 7/1964 | Australia | 206/484 |
| 164659 | 12/1949 | Netherlands | 206/484 |

*Primary Examiner*—David T. Fidei
*Attorney, Agent, or Firm*—Donald Cayen

[57] ABSTRACT

A stamp pouch comprises a flexible Kraft paper back sheet in facing contact with a flexible transparent top sheet and at least one postage stamp interposed therebetween. The facing surfaces of the back sheet and top sheet are coated with a cohesive. The top and back sheets are longer than the postage stamp, so they cohere to each other in areas above and below the stamp top and bottom edges. The top and back sheets have respective widths approximately equal to the width of the postage stamp, so the top and back sheets cohere through the perforations at the postage stamp side edges. A slit in the back sheet enables a person to easily grasp and tear it to remove the postage stamp. In alternate embodiment, a zone along associated ends of the top and back sheets are uncoated with cohesive. A person can grasp the uncoated and uncohered sheet ends to peel them apart and remove the postage stamp. The stamp pouch may be hung on an attractive display caddy for viewing by purchasers. The stamp pouch may be manufactured on a continuous basis from moving webs of the back sheet, top sheet, and rolled stamps.

15 Claims, 4 Drawing Sheets

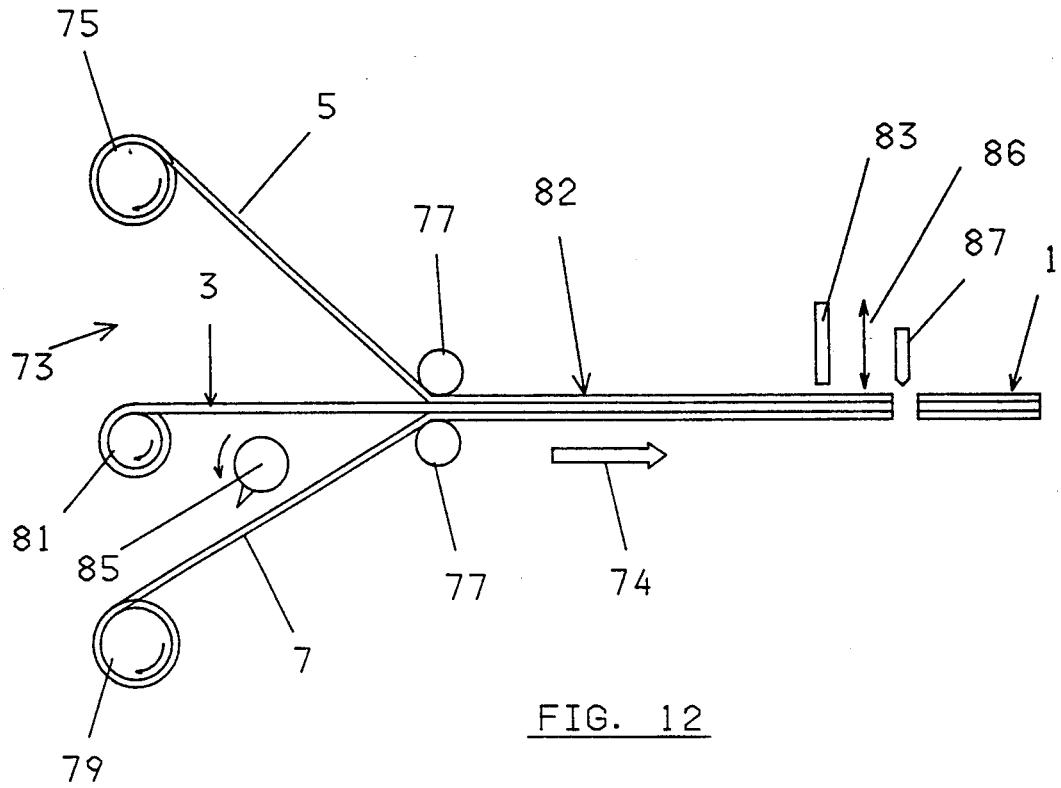
FIG. 12
FIG. 13
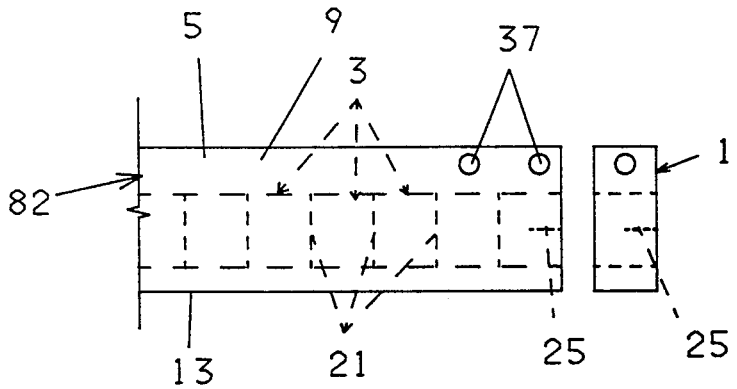
FIG. 14
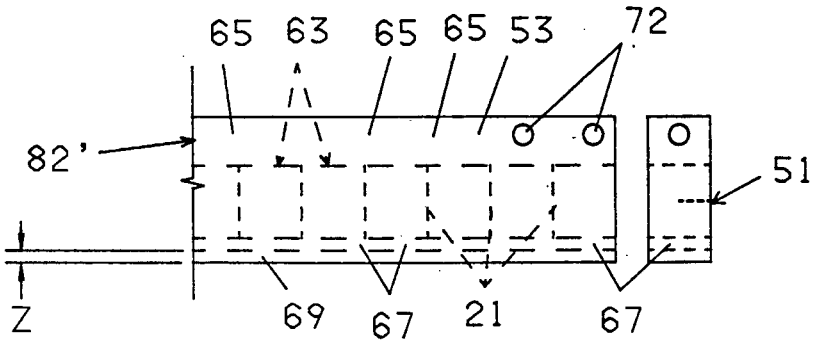

STAMP POUCH

BACKGROUND OF THE INVENTION

1. Field of the Invention

This invention pertains to packaging, and more particularly to packages for encasing and displaying postage stamps.

2. Description of the Prior Art

Various types of vending machines for storing and dispensing postage stamps have been developed. In some machines, rolls of perforated stamps are stored inside the machine. Depositing the correct coins into the machine causes an electrically operated feed mechanism to automatically unwind the desired roll and expel the correct number of stamps through a slot. The customer grips the exposed stamps and tears them along the appropriate perforations. While satisfactory in many respects, such machines are bulky and very expensive and thus are limited to use at high volume central locations such as post office lobbies.

Manually operated stamp vending machines are also known. Such machines are relatively small and are commonly placed on the counters of retail stores. Alternately, the manual vending machines may be supported on free standing posts and placed on the floor of a store. After depositing the correct coins, the customer pushes a lever on the machine to expel one or more stamps. The stamps are normally enclosed between two thin paperboard covers, which are discarded. Usually a number of such machines are owned by a vendor and placed at different retail locations. The machine vendor travels between the locations to service the machines on a more or less regular basis to replenish the stamp supply and collect the coins.

Although in widespread use, the manually operated stamp vending machines possess certain disadvantages. Normally only the machine vendor has access to the interior of the machine. Consequently, the retail store owner cannot replenish an empty machine but must wait for the vendor. Another disadvantage is that the machine occupies an undesirably large amount of valuable store space. Theft of the coins and even of the entire machine is a possibility. A major disadvantage is that the vendor must mark up the price of the stamps considerably in order to pay for purchasing and servicing the machines and to make a reasonable profit. The high mark up results in customer resistance to purchasing the stamps. Finally, the machines require exact coins for operation, which are often not at hand and inconvenient to obtain.

Thus, a need exists for improvements in the manner of making postage stamps available to the public.

SUMMARY OF THE INVENTION

In accordance with the present invention, postage stamps are stored, displayed, and sold in an economical and convenient manner without requiring vending machines. This is accomplished by encasing the postage stamps in individual flexible wrappers to create stamp pouches and hanging the stamp pouches on display caddies.

The stamp pouch is comprised of a back sheet and a top sheet with a stamp sandwiched between the two sheets. Both sheets are made of thin flexible material. The back sheet is preferably made from an opaque Kraft paper. The top sheet is preferably a transparent plastic material. The stamp face is against the transparent top sheet, so that the stamp face is visible.

Both the top and bottom sheets have the same size and shape. They have substantially the same width as the width of the stamp between its perforated side edges. The length of the sheets between their longitudinal ends is considerably greater than the length between the postage stamp top and bottom edges. The two sheets are placed in facing contact such that their corresponding edges are coterminous. The stamp perforated side edges are aligned with the corresponding sheet side edges, and the stamp is located approximately midway between the sheets' longitudinal ends.

To form the back sheet and top sheet into a unitary and convenient wrapper for encasing the postage stamp, the facing surfaces of the top and bottom sheets are coated with respective very thin films of a cohesive material. When the two sheets are brought into facing contact, they cohere to each other throughout their common areas. Neither sheet adheres to the stamp. The areas of cohesion between the two sheets include the areas between the stamp top and bottom edges and the associated longitudinal ends of the sheets, and also the areas of the stamp perforations. As a result, the stamp is firmly but visibly encased in the wrapper to create the stamp pouch. A hole is punched through the top and bottom sheets between the stamp top edge and the associated longitudinal end of the stamp pouch.

To enable the stamp to be easily removed from the stamp pouch, the back sheet is formed with a thin slit that extends from one of the side edges thereof. Although the slit may extend all the way between the two side edges of the back sheet, it is preferred that the slit extend only part way therebetween. Because the back sheet does not adhere to the postage stamp, the slit has the effect of creating two triangular shaped tabs in the back sheet adjacent the slit. The tabs are easily grasped by a consumer by bending the stamp pouch slightly along the slit. By pulling the tabs apart, the back sheet is torn completely across its width to remove the stamp from between the top and bottom sheets.

To hold a quantity of the stamp pouches, the present invention further comprises an attractive display member. The display member may be in the form of a free standing caddy that is placed on a store counter or the like in a location conveniently accessible to consumers. Alternately, the display caddy may be hung on a wall. Hooks or pegs on the caddy hold a quantity of stamp pouches by means of the holes in them. A large quantity of stamp pouches having different denomination stamps in them can be readily displayed from the caddy. The retail store owner can purchase a supply of the stamp pouches in advance. When required, he replenishes the stamp pouches on the display caddy without requiring a visit from a vendor, thereby eliminating the lost sales and service problems associated with prior mechanical stamp vending machines.

If desired, the stamp pouch may be constructed to hold two or more stamps. The length of the top and bottom sheets need not change; only the sheets' width is increased to suit the overall width of the desired number of stamps.

In an alternate embodiment, the back sheet is not slit for opening the stamp pouch. Rather, a strip or zone along a longitudinal margin of both top and back sheets is left uncoated with the cohesive film. Consequently, when the top and bottom sheets are brought into facing contact, the uncoated margins thereof do not cohere. A person is thus able to grasp the top and bottom sheets along their respective uncohered margins and pull the two sheets apart to remove the stamp.

Other advantages, benefits, and features of the invention will become apparent to those skilled in the art upon reading the detailed description of the invention.

BRIEF DESCRIPTION OF THE DRAWINGS

FIG. 12 is a diagrammatic illustration of machinery for making the stamp pouch of FIGS. 1-7.

FIG. 13 is a top view of a composite web from which the stamp pouches of FIGS. 1-7 are created.

FIG. 14 is a top view of a composite web from which the stamp pouch of FIGS. 10 and 11 are created.

DETAILED DESCRIPTION OF THE INVENTION

Figure 1:
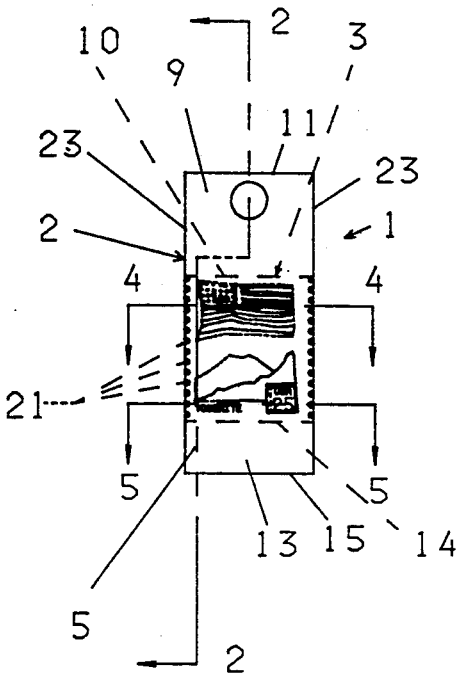
FIG. 1 is a front view of the stamp pouch of the present invention.
Figure 2:
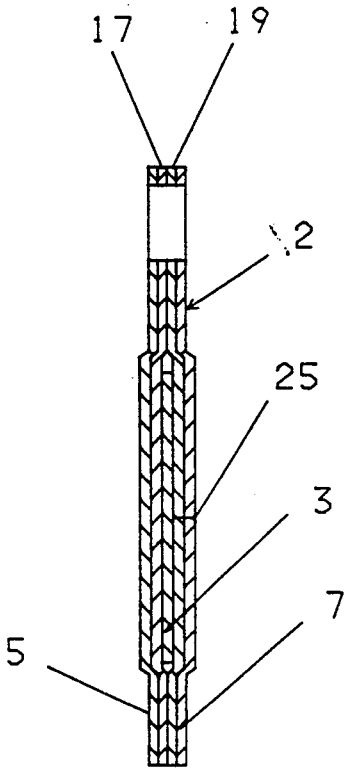
FIG. 2 is a cross sectional view taken along lines 2—2 of FIG. 1, but shown with an exaggerated thickness.
Figure 4:
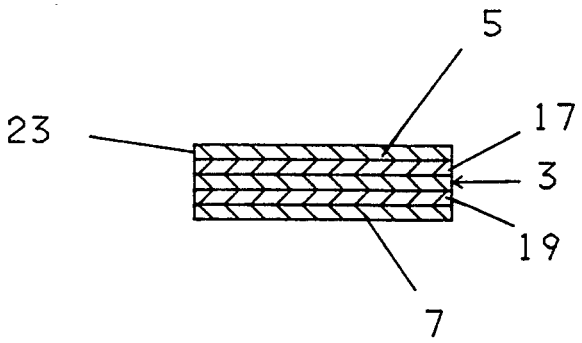
FIG. 4 is a cross sectional view taken along lines 4—4 of FIG. 1, but shown with an exaggerated thickness.
Figure 3:
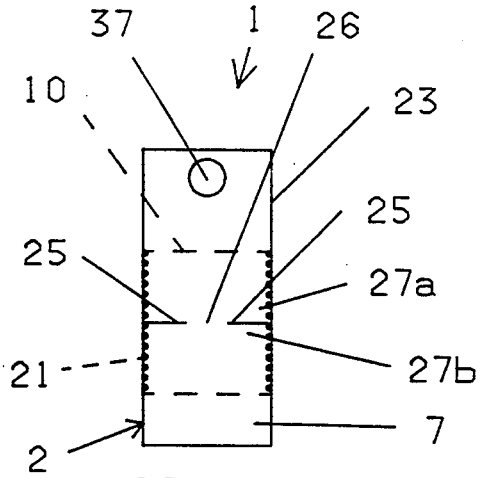
FIG. 3 is a back view of FIG. 1.
Figure 5:
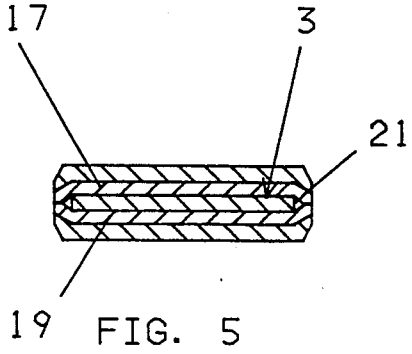
FIG. 5 is a cross sectional view taken along lines 5—5 of FIG. 1, but shown with an exaggerated thickness.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1-5, a stamp pouch 1 is illustrated that includes the present invention. The stamp pouch is particularly useful for displaying and vending a postage stamp 3, but it will be understood that the invention is not limited to postal applications.

The stamp pouch 1 is comprised of a disposable wrapper 2 and a postage stamp 3 removably encased in the wrapper. In turn, the wrapper 2 is comprised of a top sheet 5 and a back sheet 7. The top and back sheets 5 and 7, respectively, are made of thin flexible materials, and they preferably have substantially equal lengths and widths. The width of the two sheets is generally equal to the width of the postage stamp 3 between its perforated side edges. The length of the two sheets is approximately 1.6 to 1.8 times the length of the postage stamp. The postage stamp is sandwiched between the two sheets so as to form the stamp pouch 1. The stamp is placed between the two sheets in a location to leave a head area 9 between the stamp top edge 10 and the top longitudinal ends 11 of the two sheets and a foot area 13 between the stamp bottom edge 14 and the bottom longitudinal ends 15 of the two sheets.

The top sheet 5 is preferably made from a transparent medium density polyethylene material having a thickness of approximately 2 mils. The film percent elongation may be approximately MD 300 and TD 500; and the film tensile strength is preferably approximately MD 2900 psi and TD 2600 psi.

The preferred material for the back sheet 7 is a white bleached Northern Kraft paper having a 50 pound basis weight. The Elmendorf tear strength is MD 105, CD 18; the tensile is strength MD 34, CD 18; and the Mullen burst strength is 40 psi minimum.

To retain the postage stamp 3 between the top sheet 5 and the back sheet 7, the facing surfaces of the two sheets are coated with thin films 17 and 19, respectively, of a cohesive material. The film 17 on the polyethylene top sheet is preferably a water base natural rubber type adhesive. The film 19 on the Kraft paper back sheet is a latex coating having a density of six pounds/ream minimum. Suitable top and back sheets with their respective cohesive films are manufactured by Packaging Products Incorporated of Bellwood, Ill.

After curing on the top sheet 5 and back sheet 7, neither of the films 17 or 19 adheres to such materials as the paper and remoist adhesive of a postage stamp 3. Accordingly, a postage stamp can be interposed between the cohesive films of the top and back sheets without sticking to either. On the other hand, the top and back sheets do cohere firmly to each other by means of the films in the head area 9 and in the foot area 13.

It is a feature of the present invention that the postage stamp 3 is also retained between the top and back sheets 5 and 7, respectively, in the longitudinal directions despite the stamp and the top and back sheets being of substantially equal widths. Longitudinal retention is achieved by means of cohesion between the top sheet film 17 and back sheet film 19 in the areas of the perforations 21 along the stamp side edges. The stamp is thus firmly encased in the wrapper 2.

To enable the postage stamp 3 to be easily removed from the stamp pouch 1, one or more colinear slits 25 are cut longitudinally in the back sheet 7. Preferably, there are two slits 25, each of which extends from one edge 23 of the stamp pouch for approximately one-third of the width of the back sheet so as to be separated by a land 26.

A hole 37 through the top and back sheets 5 and 7, respectively, in the head area 9 completes the stamp pouch 1.

Figure 6:
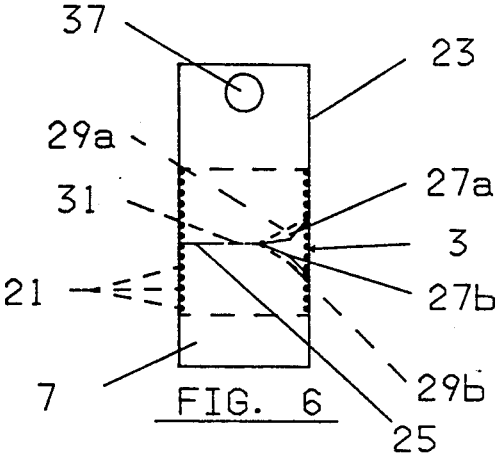
FIG. 6 is a view similar to FIG. 3, but showing the stamp pouch in an initial stage of being opened.

Looking at FIG. 6, the stamp pouch 1 is shown in a partially opened condition. A person is easily able to open the stamp pouch and gain access to the postage stamp 3 by slightly bending the stamp pouch along the slits 25 and then grasping one or both of the triangular tabs 27*a* or 27*b* created at the intersection of the back sheet edge 23 and one of the slits 25. The triangular tab 27*a* or 27*b* is bent along its respective fold line 29*a*, 29*b* between the side edge 23 and the end of the slit. Because the back sheet does not adhere to the postage stamp 3, the back sheet is easily torn across the land 26, as along tear line 31, into two pieces. The stamp is then removed from the torn stamp pouch, and the wrapper 2 is discarded into any convenient receptacle. The stamp is in perfect and sanitary condition for use.

Figure 7:
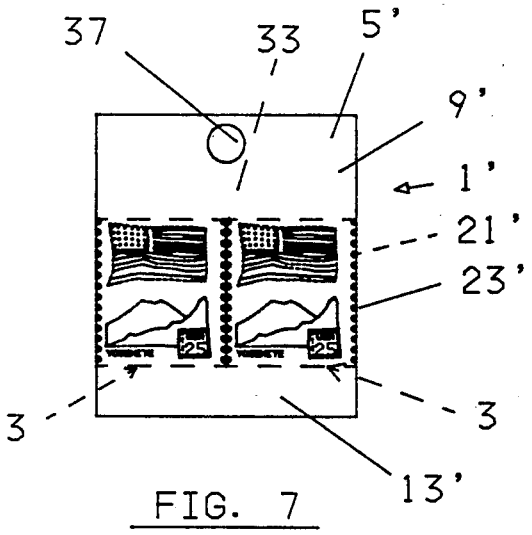
FIG. 7 is a front view of a stamp pouch according to the present invention that contains and displays two postage stamps.

FIG. 7 illustrates a modified stamp pouch 1′ that is similar in many ways to the stamp pouch 1 described above, with the exception that the stamp pouch 1′ includes two postage stamps 3. Cohesion of the top sheet 5' and back sheet 7' of the stamp pouch 1' is along the head area 9' and foot area 13' and through the perforations 21 along the stamp pouch side edges 23'. In addition, the top and back sheets cohere through the uncut perforations 33 between the two postage stamps. The back sheet 7' is slit with slits similar to the slits 25 of the stamp pouch 1 shown in FIG. 3, and the stamp pouch 1' is opened in the same manner as described in conjunction with FIG. 6.

Figure 8:
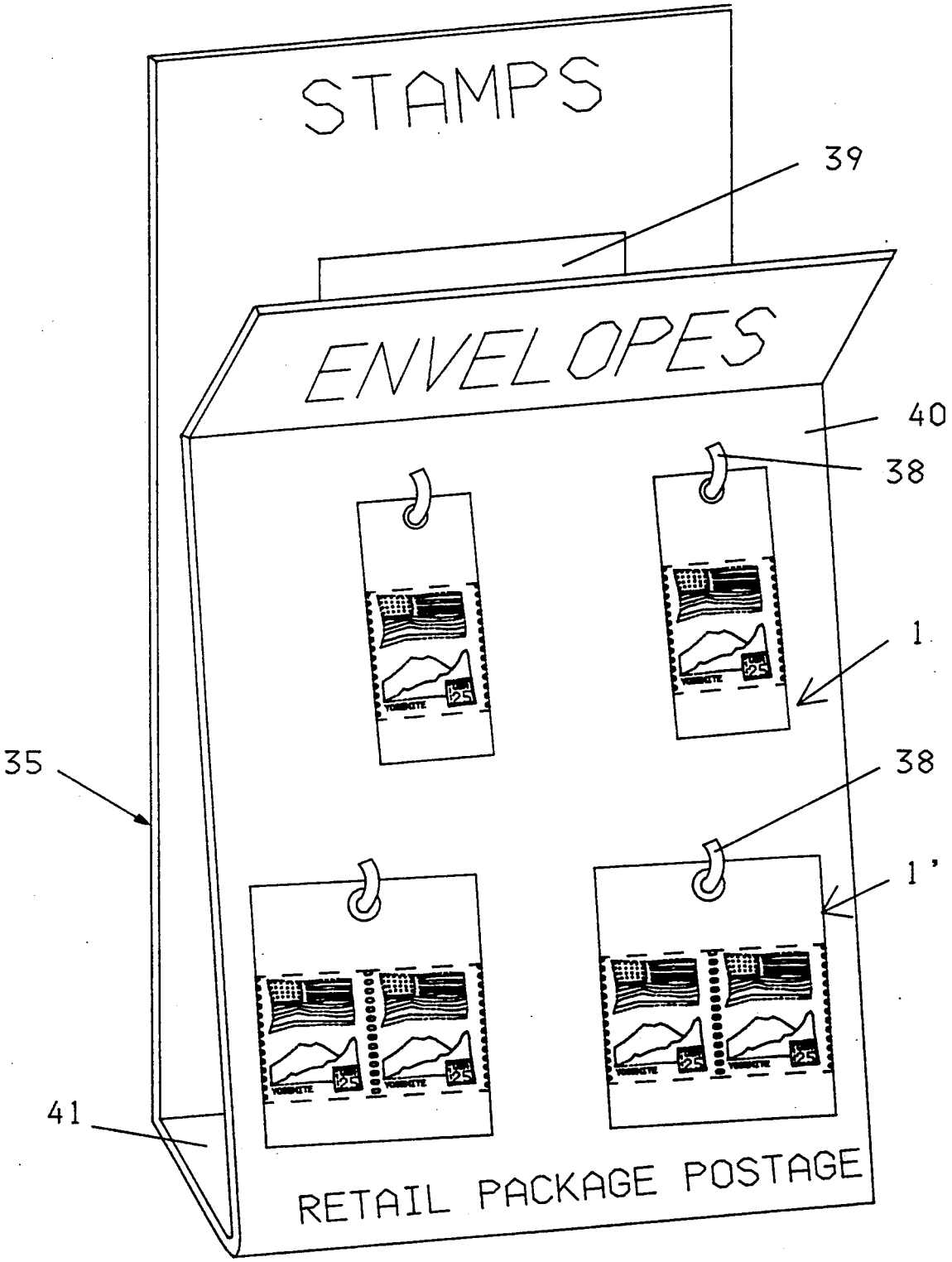
FIG. 8 is a perspective view of the stamp pouches according to the present invention shown displayed on a display caddy.

To attractively display the stamp pouches 1 and 1', they may be hung by means of their holes 37 from a display caddy 35, FIG. 8. The holes receive respective hooks 38 fastened to the front panel 40 of the display caddy 35. If desired, the display caddy may be manufactured to hold a supply of individual envelopes 39. The particular display caddy shown in FIG. 8 has a base 41 so as to be suitable for placing on a horizontal counter top. However, it will be appreciated that the caddy can also be hung from a wall or any other convenient vertical surface.

Figure 9:
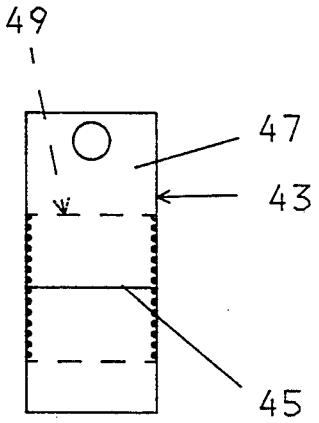
FIG. 9 is a back view of a modified embodiment of the present invention.

Turning to FIG. 9, an alternate stamp pouch 43 is depicted. The stamp pouch 43 is generally similar to the stamp pouch 1 described previously in conjunction with FIGS. 1–6. However, the stamp pouch 43 is formed with a slit 45 that extends completely across the back sheet 47 in the longitudinal direction. If desired, the stamp pouch 43 may be altered to hold two stamps 49 in a manner similar to the stamp pouch 1' described above in conjunction with FIG. 7. In both single and double stamp pouches 43, the full width slit 45 simplifies the process of removing the stamp 49 from the stamp pouch 43. In all other respects, the materials, construction, and function of the stamp pouch 43 are identical to those of the pouches 1 and 1'.

Figure 10:
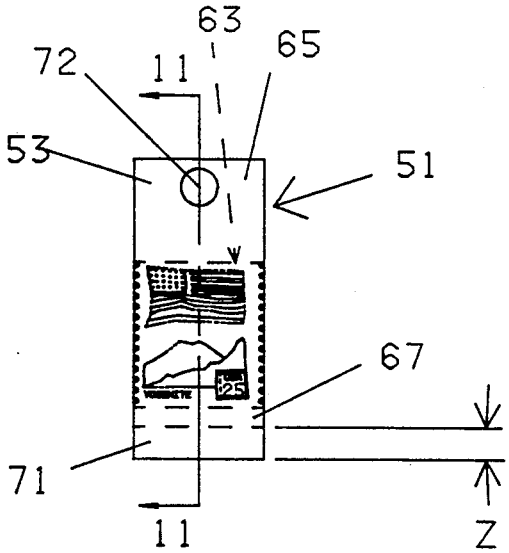
FIG. 10 is a front view of another embodiment of the invention.
Figure 11:
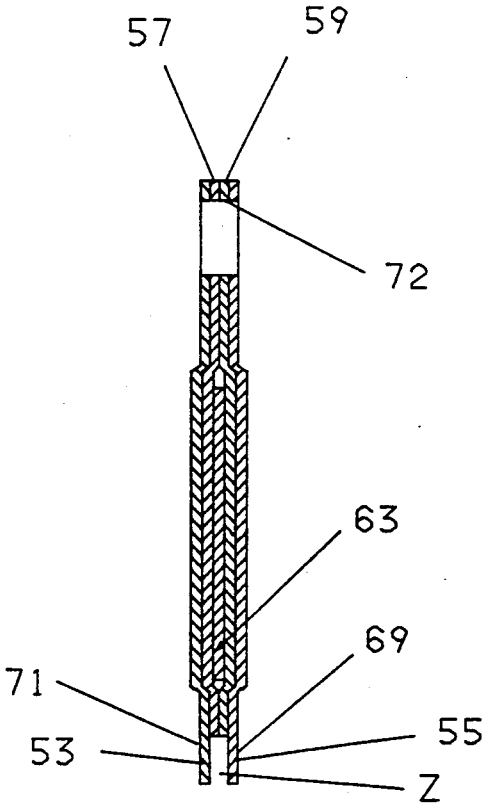
FIG. 11 is a cross sectional view taken along lines 11—11 of FIG. 10.

Now looking at FIGS. 10 and 11, a further modified stamp pouch 51 has a transparent top sheet 53 and a Kraft paper back sheet 55. The top and back sheets 53 and 55 are coated with respective films of cohesive 57 and 59 in a manner similar to that described previously in connection with stamp pouches 1, 1', and 43. However, the cohesive films 57 and 59 do not cover the entire areas of the associated top and back sheets. Rather, a zone Z along the margins 69 and 71 of the respective sheets 53 and 55 are left uncoated. If desired, only one of the sheets may have an uncoated zone. In either situation, when the sheets are placed in facing contact with each other with the postage stamp 63 interposed between them, cohesive bonding occurs at the head area 65 and at a foot area 67, but the margins 69 and 71 of the sheets do not cohere along the uncoated zone Z. The unbonded margins 69 and 71 enable a person to grip them and peel apart the top and back sheets in the foot area 67 to expose the stamp 63. Hanging holes 72 may be punched in the head area 53.

FIG. 12 shows in schematic form a machine 73 that manufactures the stamp pouches 1. The top sheet 5, precoated with the cohesive film 17 (FIGS. 2, 4, and 5), is fed as a web from a supply roll 75 in the direction of arrow 74 to a pair of nip rollers 77. The back sheet 7, precoated with the cohesive film 19, is fed as a web from a supply roll 79 to the nip rollers 77. A slitter, which may be a rotary knife 85 located between the supply roll 79 and the nip 77, cuts the slits 25 in the back sheet. Postage stamps 3 are fed from a supply roll 81 to the nip rollers between the top and back sheets, with the stamp faces against the top sheet. Pressure from the nip rollers causes the facing surfaces of the top and back sheets to cohere in the head and foot areas 9 and 13, respectively, and along the stamp perforations 21 (FIGS. 1, 3, and 6), thereby creating a composite web 82 of the top and back sheets with the stamps therebetween. Also see FIG. 13. A punch schematically pictured at reference numeral 83 reciprocates in the directions of arrow 86 to form the hanging holes 37 in the composite web 82 along the transverse center line of each stamp. Finally, a cutoff knife 87, which may be a knife that reciprocates in the directions of arrow 86, cuts the composite web completely through along the stamp perforations 21 to create the stamp pouch 1. The stamp pouches are then collected and packed for shipment to retail outlets for display, such as by hanging on a display caddy, 35, FIG. 8.

The machine 73 is easily convertible to make the double stamp pouch 1' of FIG. 7. Only the locations and timing of the punch 83 for forming the holes 37 and the cutoff knife 87 for cutting the stamp pouches 1' from the moving composite web 82 need be changed for the double stamp pouch.

To make the stamp pouch 51 of FIGS. 10 and 11, the top sheet 53 and back sheet 55 are only partially precoated with their respective cohesive films 51 and 59 so as to leave the uncoated zone Z along their respective margins 69 and 71. See FIG. 14. The zone coated top and back sheets and the stamps 63 are fed from respective supply rolls to a nip, in a manner substantially similar to that described in connection with FIG. 12, to create a composite web 82'. The top and back sheets cohere completely in the head area 65 of the composite web 82'. However, the top and back sheets cohere in the foot areas 67 only where the cohesive films are in facing contact, and zone Z along the margins 69 and 71 of the top and back sheets remain unbonded. Holes 72 are punched in the head area 65 of the composite web 82'. The composite web is cut transversely in line with the stamp perforations 21 to thereby create the stamp pouches 51.

Thus, it is apparent that there has been provided, in accordance with the invention, a stamp pouch that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A stamp pouch comprising:

a. a postage stamp having top and bottom edges with a predetermined length therebetween and opposed side edges defining the postage stamp width with perforations extending therealong;

b. a top sheet made of a thin flexible material overlying the postage stamp and having a first surface in facing contact therewith, the top sheet having first and second ends with a length therebetween greater than the length of the postage stamp, the top sheet having first and second edges with a width therebetween generally equal to the width of the postage stamp, the top sheet side edges being coterminous with associated side edges of the postage stamp, the top sheet first surface being coated with a thin film of a predetermined cohesive material; and c. a back sheet made of a thin flexible material and having a first surface that overlies and is in facing contact with the first surface of the top sheet with the postage stamp being interposed therebetween, the back sheet having opposed ends and side edges that are coterminous with the associated ends and side edges of the top sheet, the postage stamp being located intermediate the ends of the top and back sheets, the back sheet first surface being coated with a thin film of a predetermined cohesive, so that the top and back sheets cohere to each other in the areas of facing contact between the top and bottom edges of the postage stamp and the associated ends of the top and back sheets and between the perforations along the postage stamp side edges to thereby encase the postage stamp between the top and back sheets.

2. The stamp pouch of claim 1 wherein the back sheet is formed with a thin slit that extends at least part way along a single line between the side edges of the back sheet, the back sheet being tearable from one side edge thereof to the slit to thereby provide access to the stamp.

3. The stamp pouch of claim 1 wherein the back sheet is formed with at least one thin slit that extends from one of the side edges thereof for a distance less than the width of the back sheet to provide a pair of tabs for a person to grasp and open the display pouch.

4. The stamp pouch of claim 1 wherein a zone along the first surface of at least one of the top sheet and back sheet is uncoated with cohesive, and wherein the top and back sheets do not cohere along the uncoated zone when the top and back sheets are in facing contact, so that a person can grasp the top and back sheets in the uncohered zone to open the stamp pouch.

5. A stamp pouch comprising:

a. at least two postage stamps connected by perforations, each postage stamp having a perforated free side edge and top and bottom edges;

b. a top sheet made of a flexible material having a surface that is coated with a predetermined cohesive material and that is in facing contact with the postage stamps, the top sheet having first and second ends spaced apart at a length greater than the distance between the postage stamp top and bottom edges and side edges that are substantially coterminous with the associated free side edges of the postage stamps; and c. a back sheet made of a flexible material and having a surface that is coated with a predetermined cohesive material and that is in cohesion contact with the cohesive material on the top sheet with the postage stamps interposed therebetween, the back sheet having side edges and first and second ends that are substantially coterminous with the associated edges and first and second ends of the top sheet, the top and bottom edges of the postage stamps being intermediate the corresponding first and second ends of the top and back sheets to thereby create areas of cohesion between the top and bottom edges of the postage stamp and the corresponding first and second ends of the top and back sheets and between the perforations of the postage stamps.

6. The stamp pouch of claim 5 wherein the back sheet defines at least one slit therethrough that extends partially along a single line between the back sheet side edges, the back sheet being tearable colinear with the slit to provide access to the stamp.

7. The stamp pouch of claim 5 wherein the back sheet defines a slit that extends from one side edge thereof partially toward the other side edge, the slit cooperating with the back sheet side edge adjacent thereto to form a pair of generally triangular tabs useful for opening the stamp pouch.

8. The stamp pouch of claim 5 wherein a zone along the second end of at least one of the top and back sheets is uncoated with cohesive, so that the top and back sheets do not cohere along the uncoated zone to thereby enable a person to grasp the top and back sheets along their respective uncoated zones to peel apart the top and back sheets.

9. The stamp pouch of claim 8 wherein:

a. the area of cohesion between the top edges of the postage stamps and the first ends of the top and bottom sheets defines a hole therethrough for hanging the pouch for display; and b. a zone along the second end of at least one of the top and back sheets is uncoated with cohesive, so that the top and back sheets do not cohere along the uncoated zone to thereby enable a person to grasp the top and back sheets at their respective uncohered zones to peel apart the top and back sheets.

10. A display article comprising:

a. a postage stamp having top and bottom edges that define the postage stamp length and opposed perforated side edges;

b. a top sheet made of a thin flexible material with first and second ends and having a first surface in facing contact with the postage stamp, the top sheet having a length between the first and second ends thereof greater than the postage stamp length and opposed side edges coterminous with associated postage stamp side edges, the top sheet first surface being generally coated with a predetermined cohesive but having an uncoated zone along the second end thereof; and c. a back sheet made of a thin flexible material and having a first surface in facing contact with the postage stamp and having first and second ends and side edges that are substantially coterminous with the corresponding ends and side edges of the top sheet, the back sheet first surface being generally coated with a predetermined adhesive but having an uncoated zone along the second end thereof, the first surfaces of the top and back sheets being in facing contact with each other with the postage stamp interposed therebetween and intermediate the first and second ends thereof, the top and back sheets cohering in the area between the respective first ends thereof and the postage stamp top edge and between the postage stamp bottom edge and the uncoated zones of the top and back sheets.

11. The display article of claim 10 wherein the top sheet is made of a transparent material to expose the postage stamp to view.

12. The display article of claim 11 wherein the area of cohesion of the top and back sheets between the first ends thereof and the postage stamp top edge defines a hole therethrough for hanging the article for display.

13. In combination with a postage stamp having a length defined by top and bottom edges and a width defined by perforated side edges, a wrapper for removably encasing the postage stamp comprising:

a. a back sheet made of a thin flexible material having side edges that define a width substantially equal to the width of the postage stamp and first and second ends with a length therebetween greater than the length of the postage stamp, the back sheet having a first surface at least partially coated with a predetermined cohesive and being in facing contact with the postage stamp with the postage stamp lying intermediate the back sheet first and second ends and with the sheet side edges substantially aligned with the associated postage stamp side edges; and b. a top sheet made of a thin flexible material and having a first surface in facing contact with the back sheet first surface with the postage stamp interposed therebetween, the top sheet being coterminous with the back sheet, the top sheet first surface being coated with a predetermined cohesive that coheres to the first surface of the back sheet in a head area between the postage stamp top edge and the top and back sheet first ends and in a foot area between the postage stamp bottom edge and the top and back sheet second ends to encase the postage stamp between the top and back sheets, the top and back sheets further cohering between the perforations of the postage stamp side edges.

14. The combination of claim 13 wherein the wrapper back sheet defines a slit therethrough that extends from one side edge thereof part way toward the other side edge thereof, so that a person can grasp the back sheet adjacent the slit to tear the back sheet and remove the postage stamp from the wrapper.

15. The combination of claim 13 wherein the first surface of at least one of the top and back sheets is uncoated with cohesive along a zone at the second end thereof to thereby prevent cohesion of the top and back sheet along the uncoated zone and thereby enable a person to grasp the top and back sheets at their respective uncohered zones and peel apart the top and back sheets.

* * * * *